US009420881B2

(12) United States Patent
Reid et al.

(10) Patent No.: US 9,420,881 B2
(45) Date of Patent: Aug. 23, 2016

(54) VERTICALLY RETRACTABLE SHELVING FOR HOME OR OFFICE

(71) Applicants: Wayne Hyward Reid, Carson City, NV (US); Quinn Thomas Reid, Carson City, NV (US)

(72) Inventors: Wayne Hyward Reid, Carson City, NV (US); Quinn Thomas Reid, Carson City, NV (US)

( * ) Notice: Subject to any disclaimer, the term of this patent is extended or adjusted under 35 U.S.C. 154(b) by 0 days.

(21) Appl. No.: 14/197,185

(22) Filed: Mar. 4, 2014

(65) Prior Publication Data

US 2014/0252930 A1 Sep. 11, 2014

Related U.S. Application Data

(60) Provisional application No. 61/772,715, filed on Mar. 5, 2013.

(51) Int. Cl.

| | |
|---|---|
| ***A47B 67/02*** | (2006.01) |
| ***A47B 46/00*** | (2006.01) |
| *E04F 19/08* | (2006.01) |
| *A47B 51/00* | (2006.01) |

(52) U.S. Cl.

CPC ..... *A47B 46/005* (2013.01); *A47B 51/00* (2013.01); *A47B 2051/005* (2013.01); *E04F 19/08* (2013.01)

(58) Field of Classification Search

CPC ..... A47B 46/005; A47B 51/00; A47B 2051/005; E04F 19/08

USPC ..... 312/247

See application file for complete search history.

(56) References Cited

U.S. PATENT DOCUMENTS

| | | | | | |
|---|---|---|---|---|---|
| 435,561 | A * | 9/1890 | Frank | A47F 5/0892 | 211/117 |
| 929,457 | A * | 7/1909 | Macon | A47B 51/00 | 312/247 |
| 2,382,354 | A * | 8/1945 | Wales | A47B 51/00 | 312/247 |
| 2,499,791 | A * | 3/1950 | Spencer | A47B 51/00 | 312/247 |
| 2,944,540 | A * | 7/1960 | Littell, Jr. | F24C 15/027 | 126/19 M |
| 3,039,620 | A * | 6/1962 | Henry | A47B 51/00 | 108/109 |
| 3,415,586 | A * | 12/1968 | Hammond | A47B 51/00 | 108/147 |
| 5,475,949 | A * | 12/1995 | McCoy | B66B 9/00 | 312/242 |
| 5,535,852 | A * | 7/1996 | Bishop | B66B 9/00 | 187/336 |
| 5,667,035 | A * | 9/1997 | Hughes | B66F 7/02 | 182/142 |
| 7,575,098 | B2 * | 8/2009 | Hartley | B66B 11/0005 | 187/261 |
| 8,418,814 | B1 * | 4/2013 | Byers | B66D 1/54 | 182/144 |
| 8,820,003 | B2 * | 9/2014 | DeLorean | A47B 81/00 | 312/242 |
| 2006/0066188 | A1 * | 3/2006 | Crawford | E04B 9/003 | 312/247 |
| 2006/0137375 | A1 * | 6/2006 | Lishman | A47B 49/004 | 62/258 |
| 2010/0117499 | A1 * | 5/2010 | Fortier | A47C 7/0031 | 312/306 |
| 2012/0031867 | A1 * | 2/2012 | Weyler | A47B 46/00 | 211/153 |

* cited by examiner

*Primary Examiner* — Hanh V Tran

(74) *Attorney, Agent, or Firm* — IP Law Leaders PLLC

(57) ABSTRACT

A retractable shelving system is described. In one example, the retractable shelving system includes a lower shelf, a floating frame, vertical guide frames, a top frame, a motor, a sensor frame and electronic operation including remote control and sensors. In another example a cabinet is included for housing the shelving system in the attic.

14 Claims, 11 Drawing Sheets

VERTICALLY RETRACTABLE SHELVING FOR HOME OR OFFICE

CROSS-REFERENCE TO RELATED APPLICATIONS

This application claims the benefit of U.S. Provisional Application No. 61/772,715, filed Mar. 5, 2013, which is hereby incorporated by reference in its entirety.

STATEMENT REGARDING FEDERALLY SPONSORED RESEARCH OR DEVELOPMENT

Not Applicable.

FIELD OF THE INVENTION

The present invention relates to retractable storage systems, and more specifically to storage systems and shelving systems that retract up into an overhead space.

BACKGROUND OF THE INVENTION

The following is a tabulation of some U.S Patents and U.S. Patent Application Publications that presently appear relevant:

| U. S. Patents | | | |
|---|---|---|---|
| Patent Number | Kind Code | Issue Date | Patentee |
| 2,499,791 | B1 | 1950 Mar. 9 | Spencer |
| 4,412,601 | B1 | 1983 Nov. 1 | Cooper |
| 5,203,619 | B1 | 1993 Apr. 20 | Welsch et al |
| 5,475,949 | B1 | 1995 Dec. 19 | McCoy |
| 5,535,852 | B1 | 1996 Jan. 16 | Bishop et al. |
| 5,667,035 | B1 | 1997 Sep. 16 | Hughes |
| 6,131,702 | B1 | 2000 Aug. 17 | Berridge |
| 6,250,728 | B1 | 2001 Jun. 26 | Thorp |
| 6,779,634 | B1 | 2004 Aug. 24 | Slagle |
| 7,575,098 | B2 | 2009 Aug. 18 | Hartley |
| 7,963,505 | B2 | 2011 Jun. 21 | Taylor et al. |
| 8,418,814 | B1 | 2013 Apr. 16 | Byers |

| U. S. Patent Application Publications | | | |
|---|---|---|---|
| Publication Nr | Kind Code | Publ. Date | App or Patentee |
| 2003/0192836 | A1 | 2003 Oct. 16 | Ulrich |
| 2006/0066188 | A1 | 2006 Mar. 30 | Crawford |
| 2008/0296089 | A1 | 2008 Dec. 4 | Penn et al. |

A typical method of roof construction in residential and office structures include manufactured wood or cold formed steel trusses or similar types of construction. The terms "truss or trusses" are used herein to include similar types of framing methods which are common in residential structures. Trusses are typically installed with a uniform spacing. A common spacing is 24 inches in the US system or 600 mm in the SI system. Typical installation of trusses results in open space between each truss, over the height of the truss and along its length (i.e., attic space). This attic space is typically accessed through a small access hatch located in a closet, hallway or garage. Such access is generally for maintenance and is not intended for storage access.

In some cases there is also a formal attic framed inside the roof structure, particularly over garages. The attic space may be framed inside the truss, or may be framed using separate ceiling joists. However, even in these cases the access is generally through a small opening, such as, for example, with a drop down ladder. Further, older structures are typically constructed with site built framing including rafters, ceiling joists and strong backs and kickers to support the roof. The attic space created is similar to that for trusses.

Systems relative to access of attic space have generally been along two separate, but related, avenues. The first is represented by a platform lift to move items from a garage floor to and from attic storage above and the second is represented by a closet that is lifted up into the attic space. In some examples, these systems are designed for long term storage. However, there is also a need to lift items from one level to a level above for everyday use. Systems similar to that of a dumb waiter may be less than ideal for everyday use. A dumb waiter typically has at least one permanent rail over the length of the lift and typically is inside an enclosed shaft, thereby taking up floor space.

Examples of platform lift systems to move items for storage from a lower level (e.g., a garage) to a level above (e.g., an attic) are described in Bishop, Hughes, Berridge, Penn et al., Hartley, Taylor and Byers. These systems are utilitarian in nature and are not suitable for use in livable or office space. These systems are composed of a platform supported by cables that are attached to a motorized pulley system. The pulley system is generally supported on the floor/ceiling structure of the upper level. These cable supported platforms do not, by their nature, have lateral or torsional stability in the horizontal plane other than that provided by the restoring force due to the displaced angle of the cables. This can lead to the platform moving like a pendulum and twisting about a vertical axis. This movement poses problems when used in livable or office space and could result in damage to items around the shelf as well as contents of the shelf, and poses a hazard for persons near the shelf. A further disadvantage is that care must be taken to ensure the shelf is stable when being raised or lowered and is lined up with the hole in the ceiling into which the platform must enter.

Bishop et al and Hughes use sets of telescoping tubes, typically three sections in length, with the lifting cables inside the tubes. For the sets of telescoping tubes in Bishop et al and Hughes, because the lower tubes pass inside the upper tubes, there can be no attachments, such as shelves, along their length. Further, the ability to increase the height of the lift above the ceiling level is restricted because it increases the free length of the telescoping tubes, making them even more flexible. Although the tubes can provide some stability compared to other cable systems, due to their unsupported length when in the lowered position, and the method of attachment to the structure above, the amount of lateral stability provided is questionable. The indicated connections to the structure are not adequate to reliably fix the tubes and could significantly degrade with use. In addition, the weight of the platform is carried by the cables inside the tubes, thus the tubes do not benefit from increased stiffness which would result from tension in the tubes.

In addition to the disadvantages described above, platform lifts generally suffer from at least one or more of the following disadvantages: (a) Utilitarian in design, limited attempt to address aesthetics for use in livable or office space; (b) Questionable lateral stability, which is important for storage of some items and may be a safety and operational concern in occupied areas; (c) Only receives support from the upper floor or ceiling structure. In the case of trusses, a platform is only supported on the bottom chord; (d) Generally require more room to install than is available between trusses; (e) Intended to be in the raised position when not in use. These lifts are not intended to be used as shelves in the lowered position; (f) Support only a single platform; (g) Presume that the floor or ceiling framing is adequate to support the anticipated loading. Although in some cases supporting structures can be addressed during installation, there are no provisions accounted for in the systems to aid in this regard.

Examples of closet systems including shelving or cabinets that are lifted up into an attic space are described in Spencer, Cooper, Welsh et al., McCoy, Thorp, Ulrich, Crawford. Generally, these cabinets are intended for relatively light loads such as storing clothes.

Spencer shows a cabinet, called a disappearing closet, which can be accessed when in its lowered position and is hoisted up into an enclosed attic space when not in use. Although the box is lifted with cables, there are guides on the sides as well. The guides do not appear to provide much stability, but are used to guide the closet into the upper compartment. The guides are separate from the cables and are visible when in the lowered position. The cabinet does not provide for a ceiling closure when either in the lowered or raised position. The space in the attic which houses the closet in the raised position can isolate the contents form the rest of the attic space, but it is noted that in Spencer the motor is outside the box and drive chains penetrate the box, resulting in a problem with sealing the enclosure from the unconditioned attic space. Further, no mechanism is provided to lower the closet in the event of a power or equipment failure. Therefore, repairs generally would need to be made from inside the attic. This could require partial deconstruction of the upper compartment for access.

Welsh et al. shows a vertically retractable shelf which addresses the stability in the horizontal plane in a positive manner. However, the shelf in Welsh et al. does not telescope down from the ceiling. This system may only be suited to situations wherein there is a drop ceiling below a floor or ceiling structure.

McCoy shows a design for a telescoping ceiling closet. The telescoping, however, is the closet itself, so the top of the shelf cannot be lower than the ceiling. This means that to drop the bottom of the shelf to within a reasonable distance of the lower floor, the shelf must be tall, which in turn requires a tall attic space. The indicated construction and the lifting mechanisms (i.e., springs or motorized with rack-and-pinion gear on one side) indicate the system is intended for light storage, consistent with a small and light closet. Thorp and Ulrich show storage systems with similar limitations.

Crawford shows a design for a retractable shelving system which includes an enclosure into which the shelves retract. The retractable shelving appears to be stable and positively guided up into the enclosure. The system does not telescope and the top of the shelf is at the ceiling. Therefore the height of the shelving is limited, to a much greater extent than the telescoping systems, to the available height in the attic. It is touted that the shelf can be constructed from within the hole created by the cabinet space. It is noted that some access is probably required to modify framing if moderate loads are required, to run electrical, possibly repair insulation and address other systems that typically exist in an attic.

Closet lift type systems generally suffer from at least the following disadvantages: (a) Utilitarian in design; (b) When in the lowered position, do not provide a ceiling closure; (c) When in the lowered position, the cables and guides are visible and unsightly; (d) Closets that extend to the ceiling when in the lowered position, require a tall closet and therefore a tall attic space in order to be accessible near floor or table height; (e) Maintenance of the lifting mechanism (motor, pulleys, springs, guides, etc.) will typically require access from the attic and partial removal of the housing in the attic; (f) As depicted in the patents, the closet systems address relatively light loads. Methods for increasing the capacity of the supporting framing are not addressed; (g) In addition, many of the disadvantages given for platform lifts apply.

None of the above devices and patents, taken either singly or in combination, is seen to describe the instant invention.

SUMMARY

Accordingly, there is a need to provide a retractable, motorized, shelving system that can be safely operated in an occupied space and is further aesthetically pleasing to allow for both aesthetic and functional variations in shelving. Additionally, it is beneficial for the system to be simple to install in typical structures and yet be able to accommodate unusual conditions and circumstances. It is also advantageous to allow for light or heavy loads. Furthermore, it is advantageous that the shelving system allow for installation in a framed drop ceiling or in a framed cabinet which extends below the normal ceiling level.

It is also advantageous to allow for the shelf to be operated by a wall switch, keyed wall switch, remote control, smart phone, a computer, a computer via the internet, incorporated into a smart home system, or any combination of the aforementioned. It is also desirable that a manual override be easily accessible to operate in the event of a power failure or for maintenance. It is also advantageous to allow for the shelf to have sensors to automatically stop operation due to obstructions or other forces action on the shelf which may impede normal operation.

In accordance with one embodiment, the retractable shelving system may be used to store items on shelving and then raised into the attic or ceiling space above. The shelving may also be used simply for utilitarian storage, or to provide aesthetic shelving that can be raised or lowered as desired. The shelving system can also be used to lift items from a lower floor to a floor above, where items can be removed.

In one example, there are two separate stages of telescoping in sequence that are used to provide the vertical movement and provide lateral stability. The first stage of telescoping is provided by a floating frame which moves with the shelf when raised into a cabinet in the ceiling. When the top of the shelf is inside the cabinet, the frame rests on top of the shelf. As the shelf is lowered, the floating frame lowers with the shelf until the top of the shelf passes below the ceiling. This is the first stage of the telescoping shelf down to the point where the top of the shelf is approximately at the level of the ceiling or drop ceiling/box if framed below the ceiling.

The next stage of telescoping is accomplished by vertical guide tubes, one each end, which are fixedly attached to the floating shelf frame and extend downward. These tubes extend inside the lower tubes comprising the lower shelf supports. Passing inside the lower shelf tubes allows for the attachment of shelves over the height of the lower shelf tubes.

Ceiling closures are easily fastened to the bottom of the lower shelf as well as to the floating frame which stops at the ceiling level. Therefore the hole through which the shelf passes can be hidden when in the raised or lowered position and partially hidden during operation.

The installation of the cabinet can generally be accomplished through the ceiling hole for the shelf. Wiring, insulating or special conditions may necessitate some access from the surrounding attic space. However, access can be accomplished through the hole by allowing one side of the cabinet to be left open until work in the attic is completed, and then moved into position when exiting the attic. The installation of the shelving system into the cabinet may be done from the lower level, directly into the cabinet. Maintenance, if required, can be performed from below and within the cabinet, such that the cabinet remains intact.

In one example, because the lifting straps and the telescoping tubes from above are inside the lower shelf tubes, the shelves can be attached to same. This allows for variation of the shelving in number, location, and method of attachment to the tubes. The lower shelf may be a separate unit and can be easily removed and replaced with a different design as desired. In other examples, variations could include shelves for storage, atheistic shelving, platform lift, a wine rack that can be lowered into a cellar, a rack for holding kitchen utensils and many other such uses.

Advantages of the one or more embodiment described herein include, as least:

A) The cabinet into which the shelf is retracted can be installed in roof and floor framing with various characteristics, including, but not limited to:

Trusses with different roof slopes, including flat.

Trusses with sloping bottom chords.

Special framing conditions, such as a stick framed roof, similar to trusses.

Allow for strong backs to be located as needed and fastened to the vertical studs.

Allow for drop ceilings by extending the studs below the ceiling.

May be constructed as a cabinet or closet supported on a floor above.

B) The shelving system and its components can be installed and maintained from the lower level and from within the ceiling hole or cabinet.

C) The shelf has adequate stability to allow for operation or to be used as a shelf in the lowered position in occupied spaces.

D) The lower shelf has a large amount of flexibility in construction, size, number, position, materials, and uses, etc.

E) The same shelving system may be used as a shelf, a closet, a rack for hanging items, or a platform lift.

F) Ceiling closures, automatic, can be accommodated both in the raised and lowered position such that the upper cabinet is not readily visible when in the raised or lowered position. The closures are fixed to the shelving system and do not require any additional moving parts.

G) When in the lowered position, only the telescoping tubing is visible, above the shelves, adding to or even enhancing the aesthetics of the shelf in the lowered position. (However, a floating box, open in top and bottom can be used to hide the space between the top of the lower shelf and the ceiling.)

H) Relatively high lifting capacities or shelf loads can be accommodated.

I) Operated by wall switch, keyed wall switch, remote control, smart phone, a computer, a computer via the internet, incorporated into a smart home system, or by a manual override, or any combination of the aforementioned.

J) Can be equipped with sensors to stop operation due to obstruction or forces which could adversely affect normal operation.

These and other advantages of the present invention will be understood from the description of the embodiments, taken with the accompanying drawings wherein like reference numerals represent like elements throughout.

BRIEF DESCRIPTION OF THE DRAWINGS

The attached Figures show various aspects according to the present invention; any and all dimensions quoted or otherwise indicated are included merely to show one or more suitable sets of example dimensions and are not intended to limit the invention.

REFERENCE NUMERALS

Figure 1:
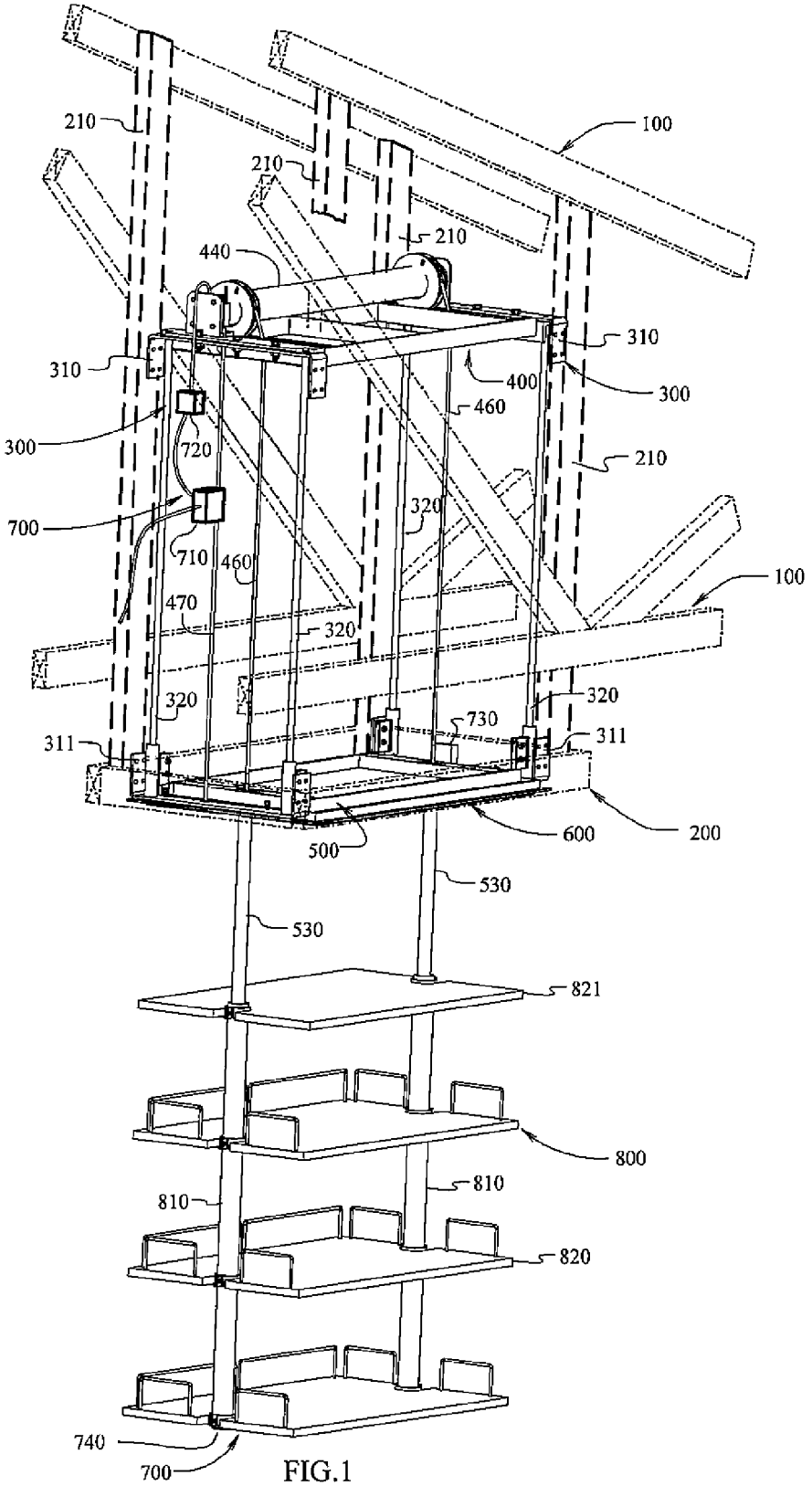
FIG. 1 is a perspective view of the installed storage system within a roof truss system, with respect to this embodiment.

100 Roof system
200 Cabinet
210 Vertical studs
220 Miscellaneous framing
230 Panel on rear face
231 Panel on left face
232 Panel on right face
233 Panel on front face
234 Panel on top face
300 Vertical guide frame

310 Top vertical guide bracket
311 Bottom vertical guide bracket
320 Vertical guide rod
330 Cap screw
340 Floating frame bracket assembly
341 Bearing housing tube
342 Linear sleeve bearing
343 Bracket for floating frame
400 Top frame
410 Main frame bar
411 Cross bar pulley support
412 Center cross bar
413 Pulley and shaft
414 Left angle support
415 Right angle support
416 Bolt and nut
420 Right motor bracket
421 Bushing
430 Left motor bracket
431 Cap screw
440 Motor tube assembly
441 Motor tube
442 End cap idler
450 Winding spool
460 Lifting straps
470 Manual drive shaft
471 Bushing for drive shaft
480 Tubular Motor with crown and motor adapter
500 Floating frame
510 Main floating frame
515 Bolt and Nut
520 Cross frame
525 Connection block
530 Vertical guide tube
540 Slide bearing
550 Ceiling panel
551 Shock absorber
600 Sensor frame assembly
610 Sensor frame
620 Threaded studs
630 Threaded stud for sensor
640 Lower spring
641 Upper spring
642 Nut
700 Electrical and control system
710 Electric receptacle
720 Receiver/computer
730 Acceleration sensor
740 Pressure or Acceleration sensor(s)
800 Lower shelf assembly
810 Lower shelf support tube
820 Shelf
821 Top shelf/lid
830 Shelf support
831 Shelf bracket
832 Shelf bracket spacer
833 Bolt (not shown)
834 wing
900 Connecting rod assembly
910 Connecting rod
920 Bottom connector
921 Buckle
922 Stop
923 Set screw

DETAILED DESCRIPTION OF THE INVENTION

The one example embodiment will be described with reference to the accompanying figures. It is to be understood that the specific apparatus and system illustrated in the figures and specification are simply an exemplary embodiment of the invention.

A retractable shelving system installed in the attic space between roof trusses is shown in FIG. 1. In one example, the system includes a lower shelf (800), a floating frame (500), vertical guide frames (300), a top frame (400), a motor (440), a sensor frame (600) and electronic operation including remote control and sensors (700). Further, the system may include a cabinet (200) for housing the system in, for example, an attic.

Generally, the parts may be made of metal, such as aluminum, steel, stainless steel, plastic, or of sturdy materials. These structural components are preferably of a unitary construction, except as noted, to provide strength and rigidity. Such components may be molded, extruded or machined into the appropriate dimensions. The material assumed in the example embodiment illustrated in FIG. 1 is aluminum in order to reduce weight and provide corrosion protection. A combination of metals (or plastics, or other suitable materials), such as aluminum for hidden parts and stainless steel or anodized aluminum for exposed parts (such as portions of the floating frame and lower shelf) may be used. When mixing materials, due consideration of the effects of dissimilar metals should be considered. Fasteners may be aluminum or stainless steel, nylon or other suitable materials, and may be screws or bolts or other fasteners as known in the art.

It is also noted that in the example illustrated in FIG. 1 none of the wearing parts are visible. Particularly, the telescoping tubes themselves are not directly in contact. Referring to FIG. 19A, the slide bearings (540) that isolate the lower shelf tube (810) and the vertical guide tubes (530) are not visible. Thus, the finish on the exposed tubes is not adversely affected by wearing.

Figure 25:
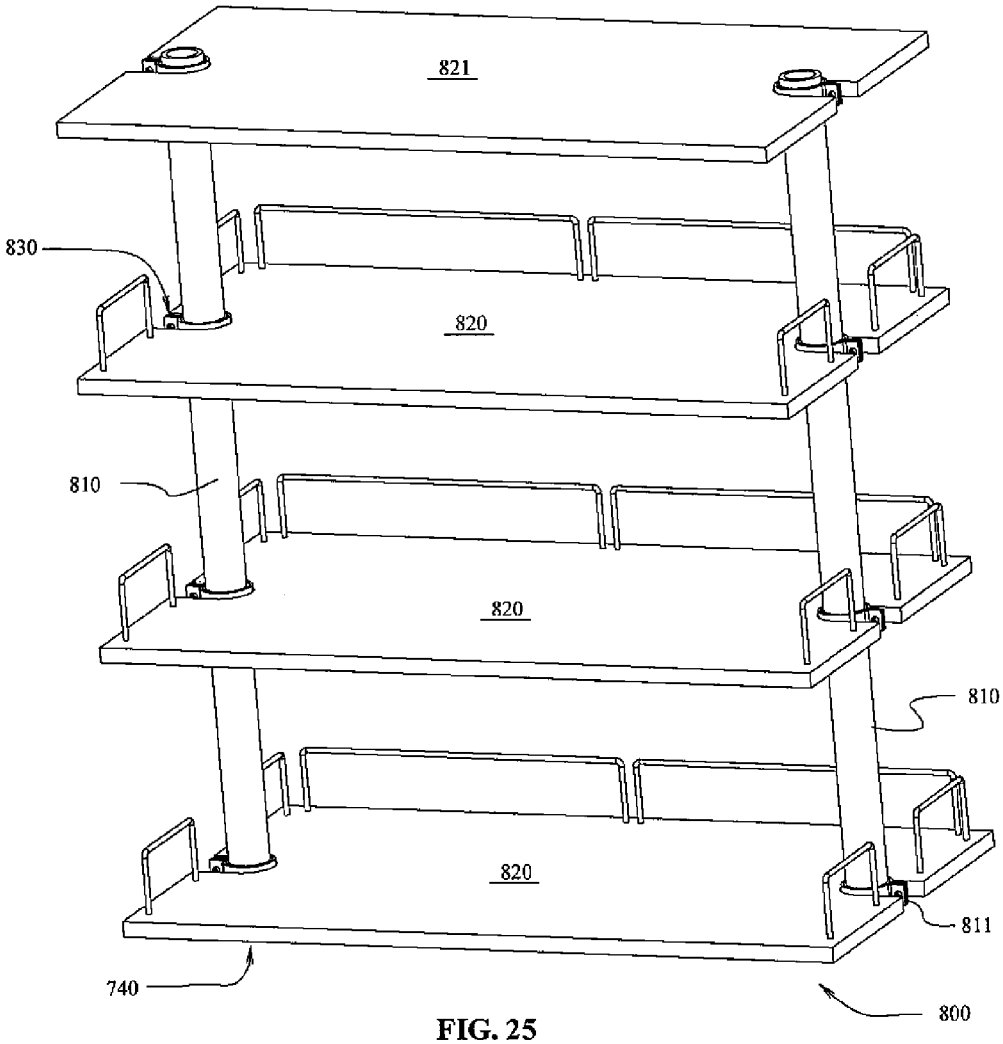
FIG. 25 shows an embodiment of the lower shelf.

The lower shelf (800) as shown in FIG. 25 includes the lower shelf support tube (810), the shelving (820) and the top shelf (821) and the shelf support (830). The lower shelf support tubes (810) provide the main structure for the shelves (820) and the connection to the lifting mechanisms. Said tubes may be made of metal, as noted above, or a suitable plastic, or any other suitable material. The shelving (820) may be constructed with any suitable material such as wood, glass, steel, and may be individually crafted or injection molded or any other material and method as is known in the art. The top shelf (821) is intended to provide a surface indicating the top of the usable storage. As such, the top shelf (821) may be constructed as a shelf, or may include some other means to demark the upper limit of storage on the shelf, or even eliminated entirely.

Figure 26:
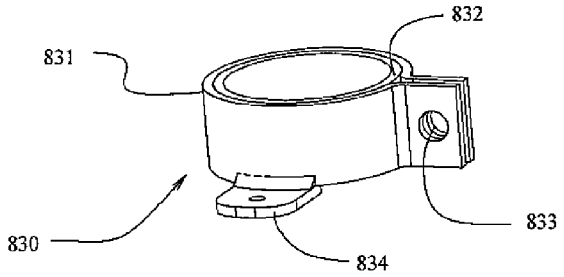
FIG. 26 shows a shelf bracket

The shelf support (830) as shown in FIG. 26 includes the bracket spacer (832), the shelf bracket (831), and a fastener (833). The bracket spacer (832) is constructed of a soft, pliable material such as rubber, and is wrapped around the lower shelf support tube (810). The bracket spacer (832) may also be adhered to the adjacent inside surface of the shelf bracket (831). The shelf bracket (831) is bent to match the circumference of the lower shelf support tube but with a small gap and ears by which the fastener (833) (the male portion of the fastener is not shown) can be tightened to provide a clamping force. Wings (834) are fixedly attached to the shelf bracket (831) and provide for vertical and rotational support of the shelves (820). It is noted, however, that the shelves (820) may be fixed to the lower shelf support tubes (810) by other means as known in the art.

Some of the parts are referred to as left and right and are based on the orientation of the figures on the drawings. This is for reference only and is not intended to imply which side the part is actually on. For the orientation of this embodiment, the left side is the motor side and the right side is the opposing side. The front and back sides are parallel to the trusses.

Figure 2:
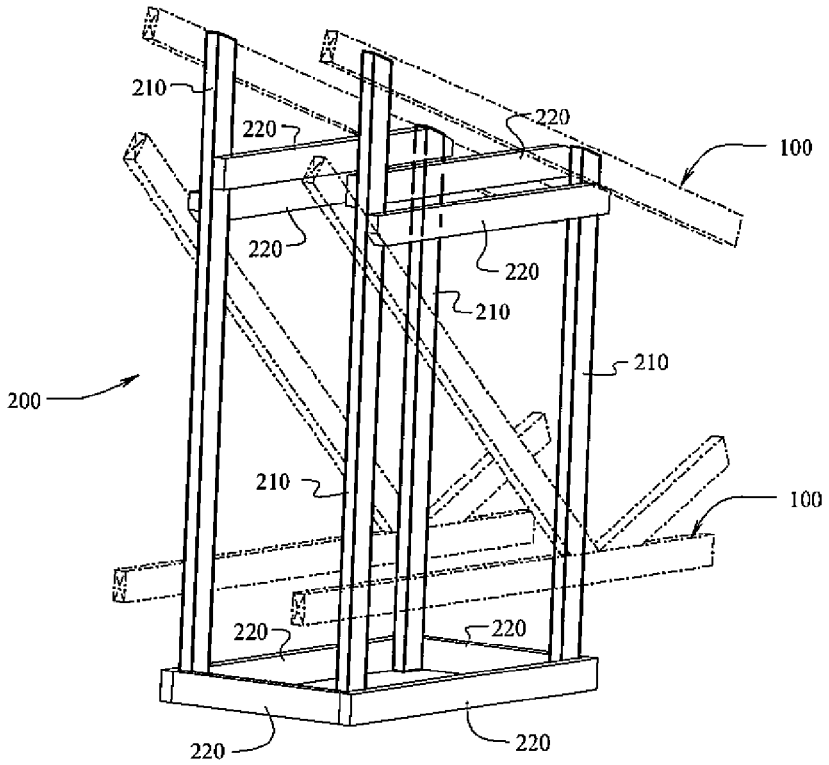
FIG. 2 shows the addition of framing to the roof truss system which will support the shelving systems, form a drop ceiling and will provide framing to support construction of the cabinet.
Figure 3:
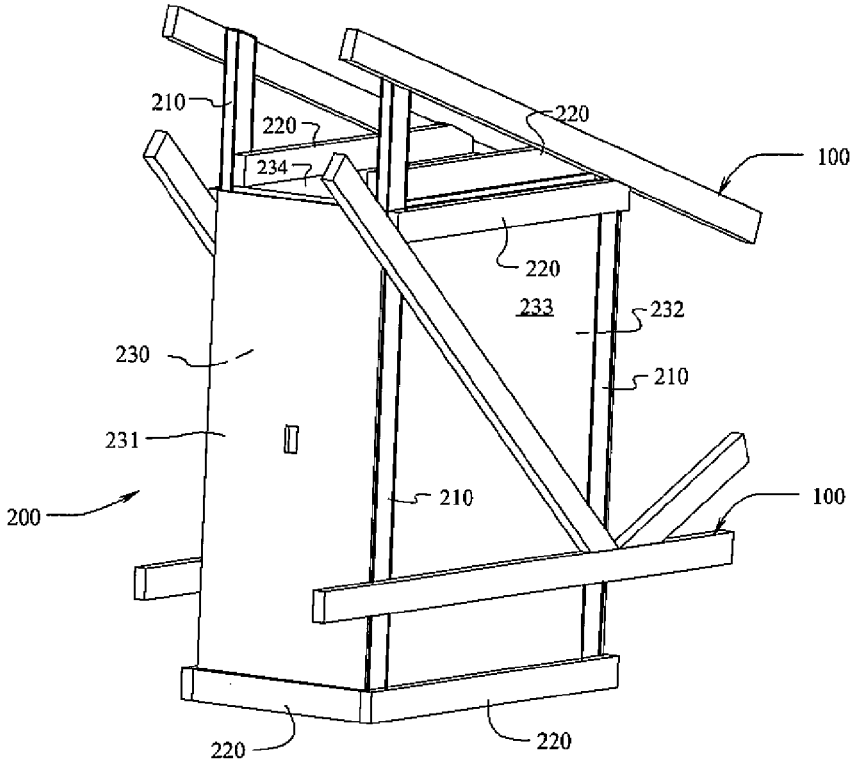
FIG. 3 shows the construction of the cabinet within the truss system, including a ceiling drop panel, which houses the storage system and its components.

The shelving system is installed into a cabinet (200) as shown in FIGS. 1, 2 and 3. The support of the shelving system is accomplished by fastening the vertical guide frame (300) directly to vertical studs (210) in each corner of the cabinet (fasteners are not shown). The vertical studs (210) distribute loads from the shelving system to the roof trusses and extend down to form a drop ceiling. It is noted that a drop ceiling as shown may be provided, but is not necessary. Additional framing (220) may be added to the roof structure as necessary and as known in the art. Studs and framing may be of wood or steel, or other material as is known in the art.

The cabinet (200) in this embodiment is shown in FIG. 3. Construction of the cabinet (200) includes a rear panel (230), implied but not shown, a left side panel (231) a right panel (232), implied but not shown, a front panel (233) and an upper panel (234). The cabinet panels may be constructed with gypsum wallboard or other standard building products as known in the art, or may be molded or formed using sheet metal or aluminum, plastics, or may be by injection molding, rotomolding, or otherwise fabricated in a manner such as known in the art. The cabinet (200) is sealed and insulated such that the shelf mechanism is in the conditioned envelope of the living space below. It is noted that other embodiments may not require isolation from the space into which the shelving is retracted. Therefore the vertical studs (210) are used for support, but the cabinet itself may be eliminated or, if desired, may be constructed as a finished cabinetry as known in the art.

Figure 12:
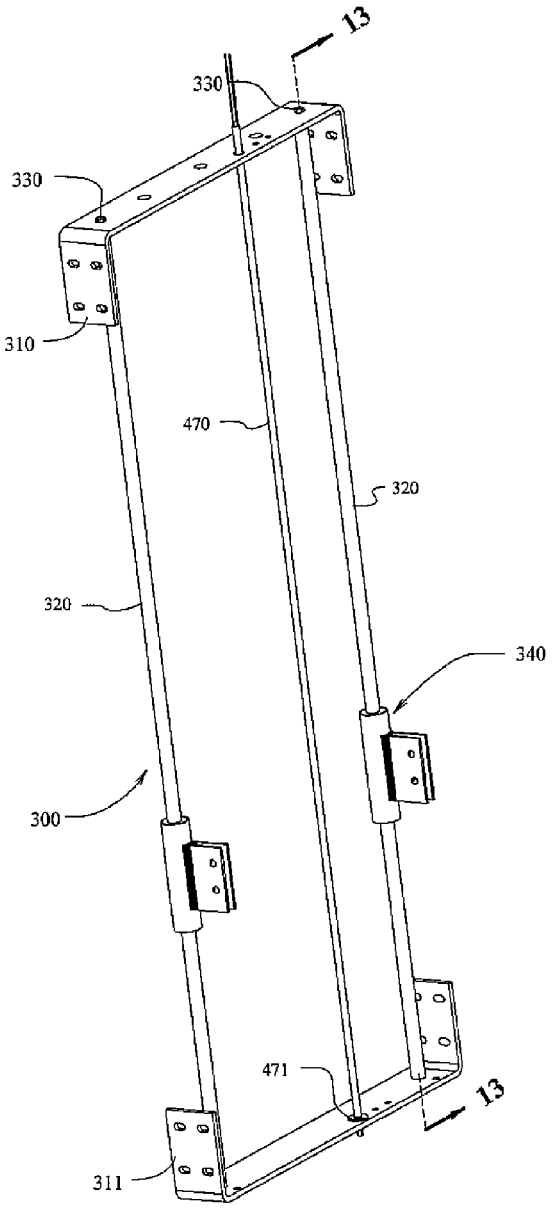
FIG. 12 shows a perspective of the vertical guide frame.
Figure 13:
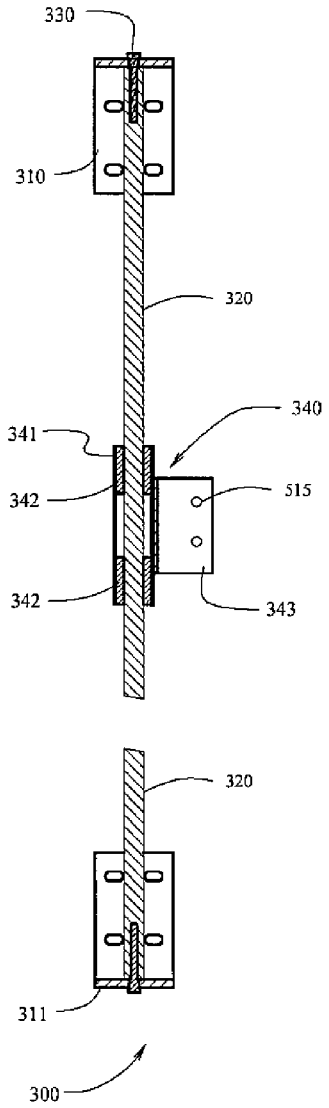
FIG. 13 shows a cross section of the vertical guide frame.

As shown in FIGS. 12-13, the two opposing (right and left) vertical guide frames (300) each include two opposing vertical guide rods (320) which support the floating frame bracket assembly (340) and constrain said floating frame bracket assembly (340) to linear vertical motion. The vertical guide rods (320) are fixed to the inverted U shaped top vertical guide bracket (310) and the U shaped bottom vertical guide bracket (311) using cap screws (330). Also shown is the manual drive shaft (470) passing through a hole in the upper vertical guide bracket and supported by a bushing and restraining ring (471) at the lower vertical guide bracket. Holes are provided in the vertical legs of the guide brackets for attachment of the top frame (400) and to allow access to limit switches which may accompany the motor (480). Additionally, holes in the vertical legs of the vertical guide frame brackets (310) and (311) are provided for fastening to the vertical studs (210). Said holes may be horizontal long slotted holes to facilitate positioning relative to the opposing vertical guide frame (300) and plumbing the shelving system. The aforementioned parts are anticipated to be constructed with aluminum or other suitable materials. The vertical guide rods (320) may be made of high strength aluminum or stainless steel or any other suitable material to improve wearabilty.

As shown in FIG. 13, the floating frame bracket (340) includes a bracket (343) for attachment of the floating frame (500), two opposing linear sleeve bearings (342) and a bearing housing tube (341). The bracket has two holes to accept bolts (515) for fastening of the floating frame (500). Said holes may be horizontal long slotted holes to allow for adjustment as may be necessary to allow the floating frame (500) to freely move vertically on the vertical guide rods (320). The floating frame bracket (343) is fixedly attached to the bearing housing tube (341).

Figure 14:
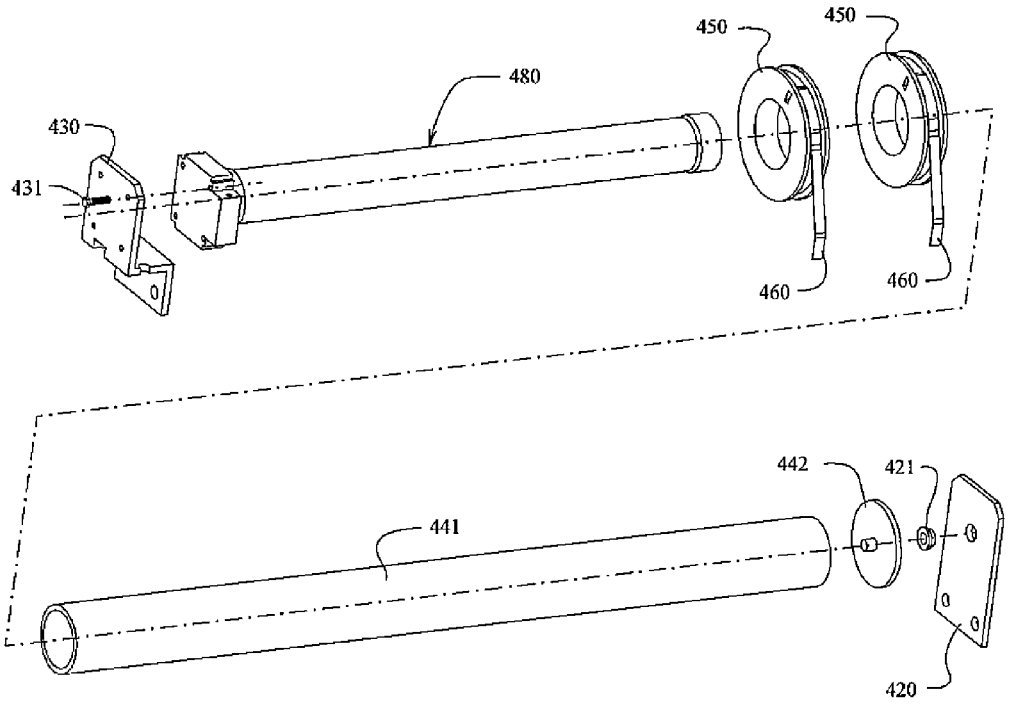
FIG. 14 shows an exploded view of the motor assembly.
Figure 15:
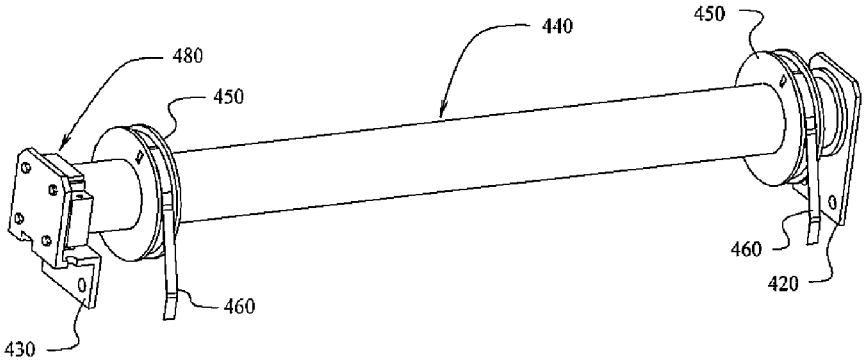
FIG. 15 shows a perspective of the motor assembly.

As shown in FIGS. 14-15 the tubular motor, as known in the art, (480) is inserted into a motor tube (441). The motor tube (441) is sized to accommodate the clear inside diameter required by the tubular motor (480) and is made of metal. The tubular motor (480) and the associated motor accessories including the crown, motor tube, drive adapter (gear) idler bearing and idler bearing cradle, and fastening, limit switches, manual operation, etc. are as known in the art. The left motor bracket (430) is fastened to the motor using cap screws (431) or other fastener types as required by the motor. It is noted that for the motor used in this embodiment, the left motor bracket (430) is bent such that the motor is shifted to the left, thus allowing for the vertical manual drive shaft. The idler (442) at the right end is inserted into a bushing (421) which is fixed into the right motor bracket (420). It is noted that a tubular motor is used in this embodiment, but any suitable motor and accompanying drive system may be used as known in the art.

As shown in FIGS. 14-15, the motor tube (441) is passed through the winding spools (450) which are fixed to the tube with fasteners (not shown). The lifting straps (460) are fixed to and wrapped around the winding spools (450). The tubular motor (480) applies a torque to the motor tube (441) which turns the winding spools (450) and winds the lifting straps (460), thus raising and lowering the lower shelf (800). The winding spools (450) may be of metal or plastic and are channeled so as to guide and contain the lifting straps (460). In one example, the lifting straps (460) are flat nylon lifting straps, but may also be nylon cord, or steel wire or steel rope or composites or other suitable materials as known in the art. FIG. 15 shows the motor tube assembly (440).

Figure 16:
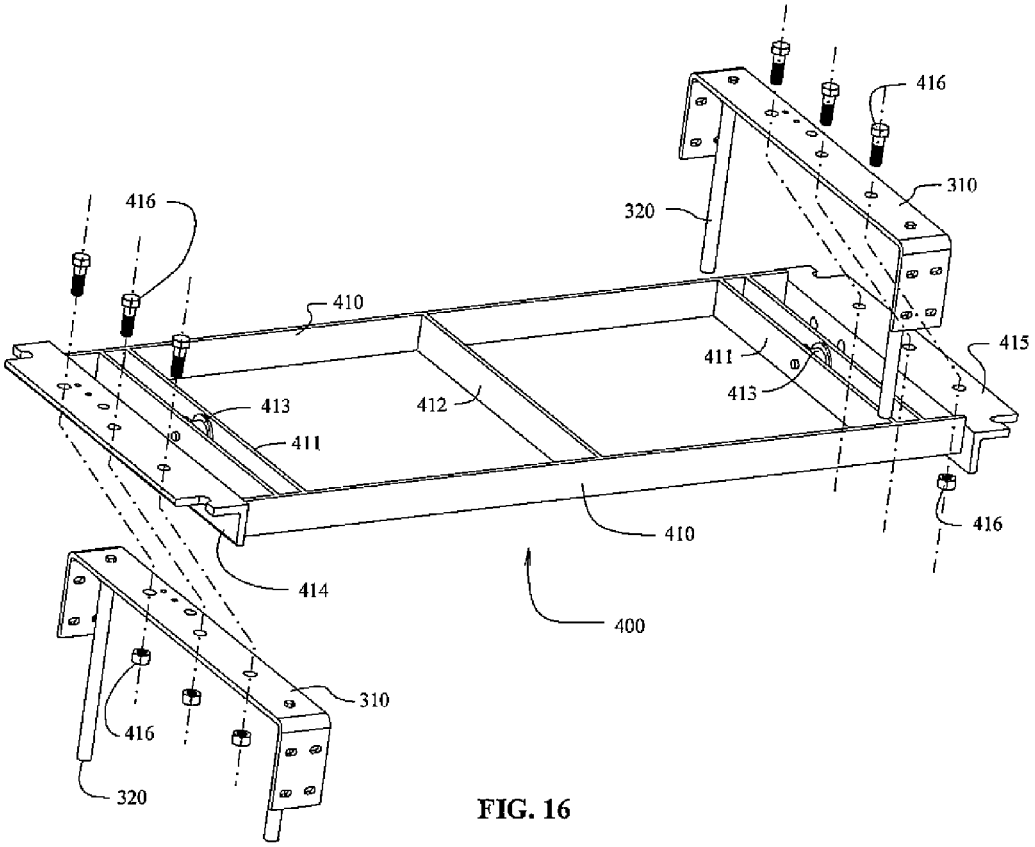
FIG. 16 shows an exploded view of the top frame.
Figure 17:
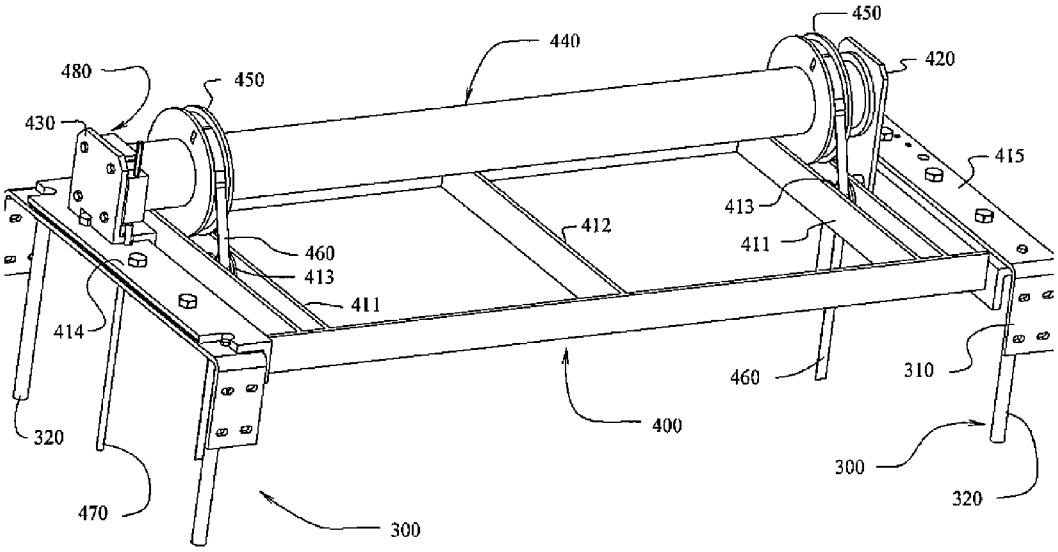
FIG. 17 shows a perspective of the motor assembled on the top frame.

An exploded view of the top frame (400) and its connection to the vertical guide frames (300) is shown in FIGS. 16 and 17. The top frame (400) includes opposing metal main frame bars (410) which are connected by and rigidly fastened to a center cross bar (412) and two sets of cross bar pulley supports (411). The shaft of the pulley and shaft (413) is fixed to opposing cross bar pulley supports (411). The pulley is metal or nylon or other suitable material and is channeled to guide and redirect the lifting straps (460). The main frame members are fixedly attached to the left angle support (414) and the right angle support (415).

In order to facilitate the installation of the frame assembly from inside the cabinet, the left angle support (414) is located higher on the top frame (400) than the right angle support (415). This allows the top frame (400) to be angled upward and set on top of the left vertical guide frame bracket (310) and then rotated up into place and fastened to the underside of the right vertical guide frame bracket (310). The top frame (400) is fastened to the vertical guide frames (300) using bolts and nuts (416).

Figure 18:
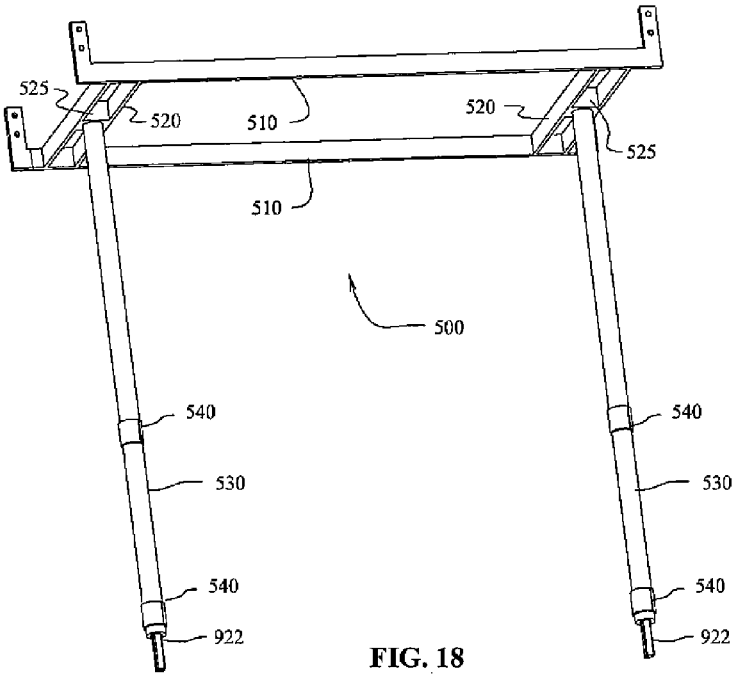
FIG. 18 shows a perspective of the floating frame.

As shown in FIG. 18 the floating frame (500) includes the main floating frame (510), cross frames (520), connection blocks (525), vertical guide tubes (530) and the slide bearings (540). The opposing main floating frames (510) are connected by and rigidly fastened to the cross frames (520). The vertical guide tubes (530) are fixedly attached to the connection block (525). The connection blocks may be threaded such that vertical guide tubes (530) may be attached by screwing the tube into a block or other methods as known in the art. The vertical guide tubes (530) are necked down at the locations of the slide bearings (540) so as to restrain the bearings and provide for thicker slide bearings. The slide bearings (540) are in the shape of a split tube and are made of nylon or other suitable material. Said bearings provide for the smooth telescoping inside of the larger diameter lower shelf support tubes (810) as shown in FIG. 19A.

As shown in FIG. 13, the main floating frame members have short vertical legs at each end for attachment to the floating frame brackets (340). The connection is made using bolts and nuts (515) which may be placed in horizontal long slotted holes as indicated in the description of the floating frame bracket (340). The attachment is made such that when the floating frame (500) is moved or pushed in a direction transverse to the long direction of the floating frame (front to back) a restoring couple is created by the horizontal forces resulting between the linear slide bearings (341) and the vertical guide rods (320) at each of the four corners. This is the method by which lateral stability is maintained when the shelf is raised or lowered.

Figure 19:
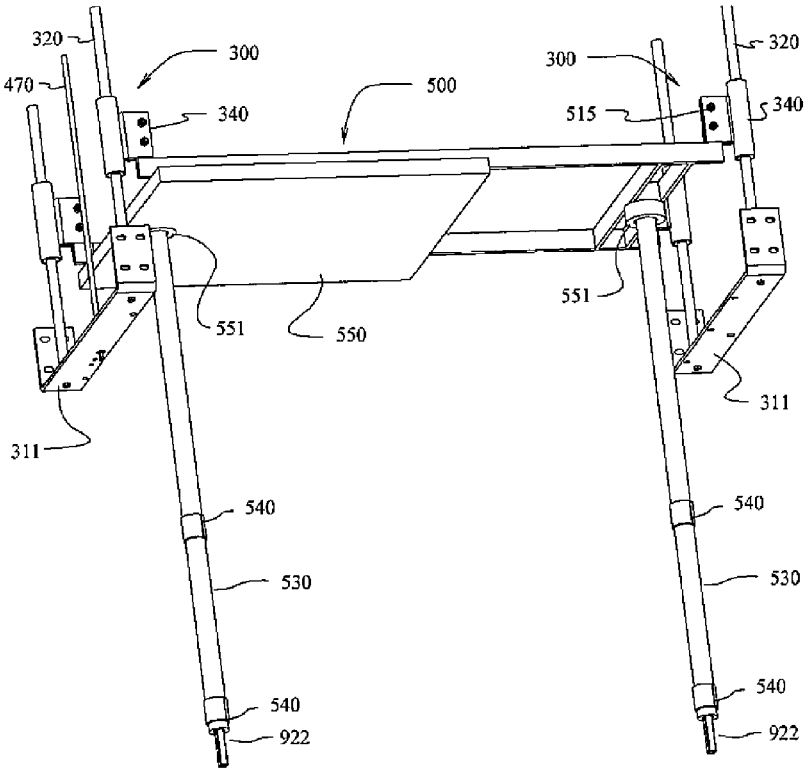
FIG. 19 shows a perspective view of the installed floating frame.
Figure 19A:
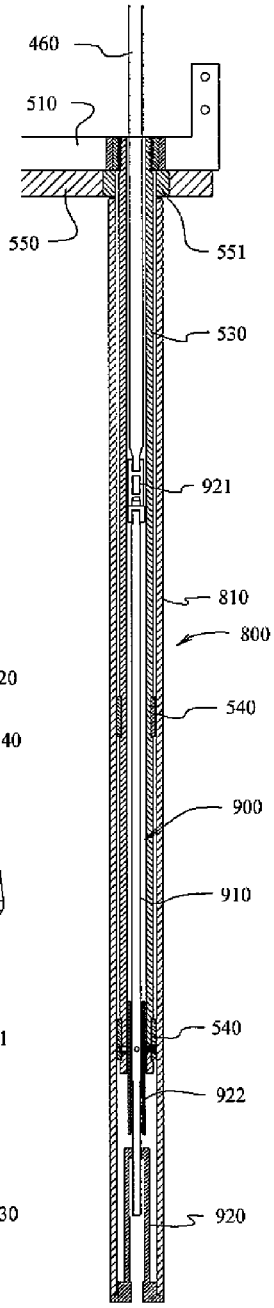
FIG. 19A shows a cross section of the assembled vertical guide tube with lifting strap components and lower shelf tube.

Also shown in FIGS. 18 and 19-19A are the stops (922). The stops (922) are used to transfer the vertical load carried by the straps to the vertical guide tubes (530), see FIG. 21 and FIGS. 4 and 8. In this way, when the lower shelves are in the lowest position, the vertical load path is from the stops (922) to the vertical guide tubes (530), to the main floating frame (510), to the floating frame bracket assembly (340) and then by bearing of each of the floating frame brackets directly onto the bottom frame guide brackets (311). This provides for substantially more stability when the lower shelf is in its lowest position. Shock absorbers (not shown) may be placed between the bottom vertical guide frame bracket and the floating frame bracket.

As shown in FIGS. 19 and 19A, a ceiling panel (550) (note the panel is partially removed for clarity) can be fixed to the bottom of the main floating frame (500) such that when the floating frame is in its lowest position (see FIGS. 4 and 8), the cabinet space above is closed off. Also shown is a shock absorber (551) that is placed in an oversized hole in the ceiling panel to absorb the impact of the lower shelf support tube (810) on the floating frame's connection blocks (525). Note that the floating frame (500) is lifted and lowered by the bearing of the lower shelf support tubes (810) on the shock absorbers (551). Note further, that the floating frame (500) does not carry any vertical load from the lower shelf until the lower shelf is in its lowest position and the lifting straps (460) are slack.

The ceiling panel (550) can be made of any suitable finish material to match the desired aesthetics and can be as simple as a plastic sheet or as complicated as an ornate wood panel. The shock absorber (551) can be made of rubber or any suitable material known in the art.

Figure 4:
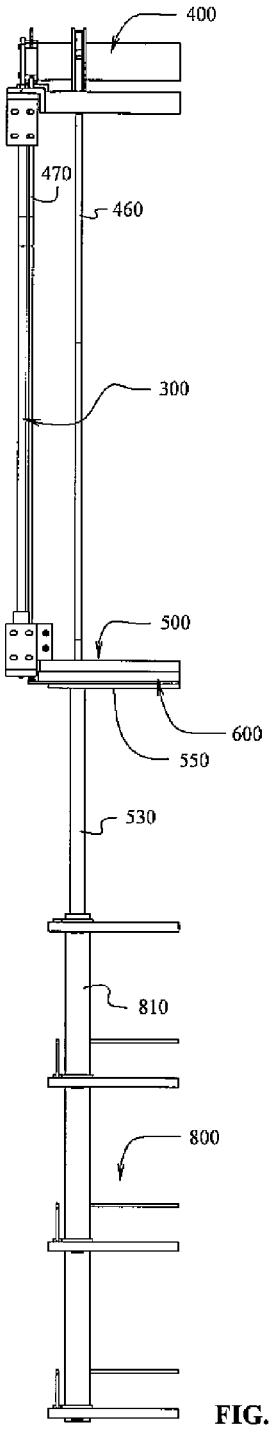
FIG. 4 shows a vertical section of the left side of the shelving system in the lowered position.
Figure 5:
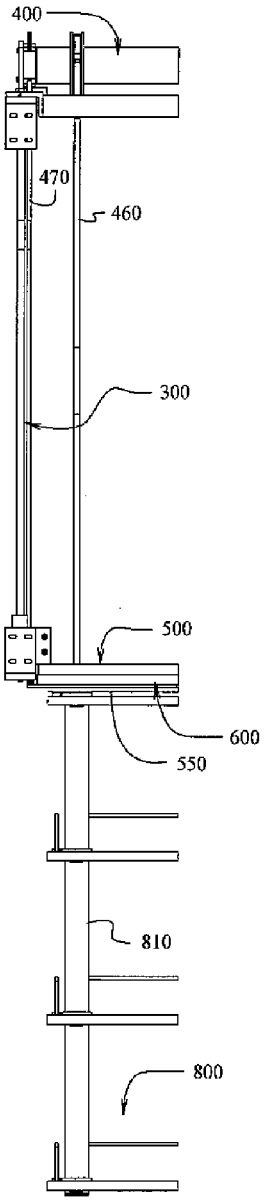
FIG. 5 shows a vertical section of the left side of the shelving system partially raised such that the top of the lower shelf is at the ceiling level.
Figure 6:
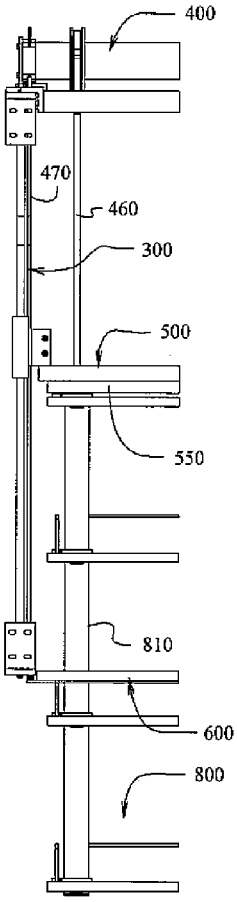
FIG. 6 shows a vertical section of the left side of the shelving system raised to a position where the lower shelf is midway up into the cabinet.
Figure 7:
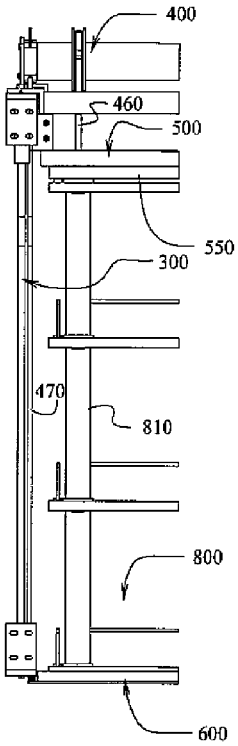
FIG. 7 shows a vertical section of the left side of the shelving system fully raised into the cabinet.
Figure 8:
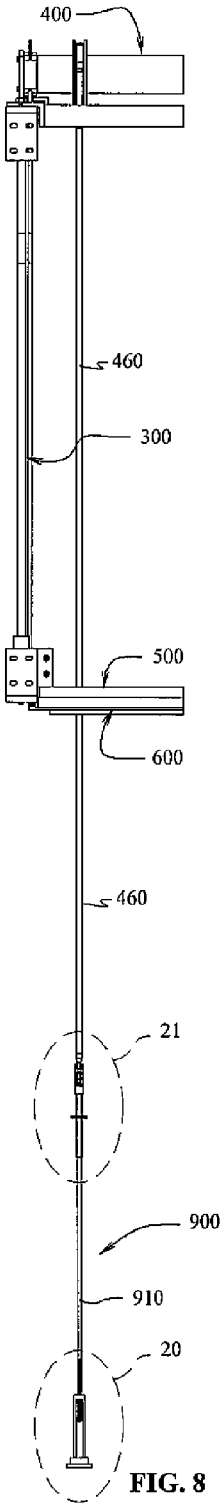
FIG. 8 shows the lifting strap components when the shelving system is in the position corresponding to FIG. 4.
Figure 9:
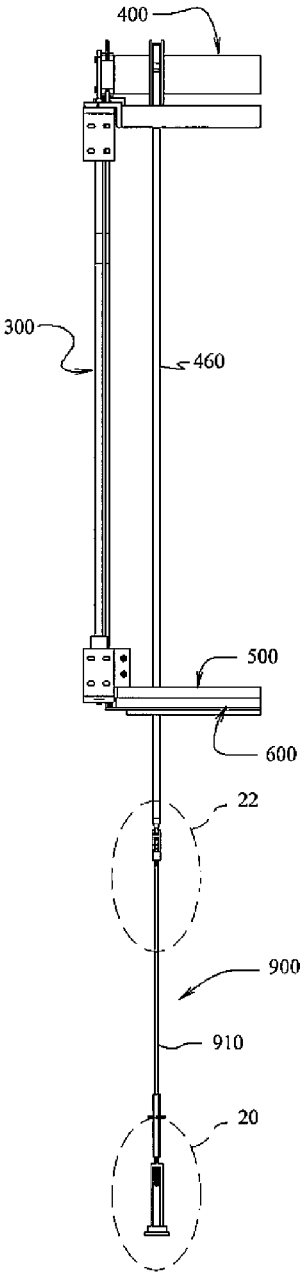
FIG. 9 shows the lifting strap components when the shelving system is in the position corresponding to FIG. 5.
Figure 10:
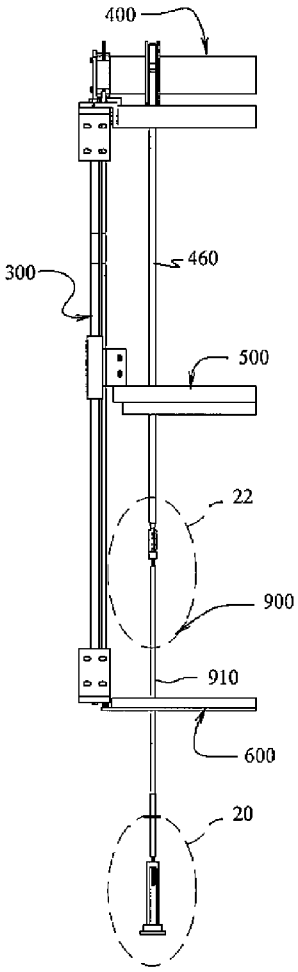
FIG. 10 shows the lifting strap components when the shelving system is in the position corresponding to FIG. 6.
Figure 11:
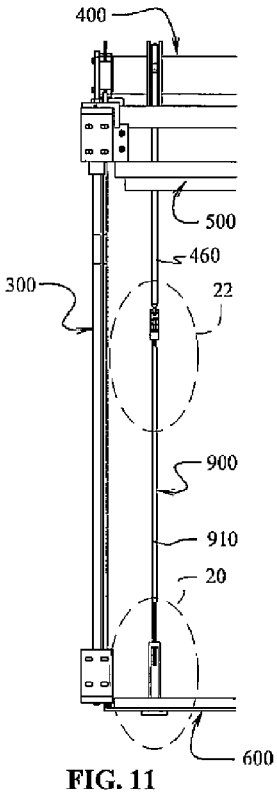
FIG. 11 shows the lifting strap components when the shelving system is in the position corresponding to FIG. 7.

FIG. 19A and FIGS. 8, 9, 10, 11 and FIGS. 20, 21, 22 show the lifting connector elements (900) as follows: lifting strap (460) is attached at the lower end to the buckle (921), which is fixedly attached to the connecting rod (910), which is attached to the bottom connector (920). The buckle is made of metal and allows for looping the strap, as known in the art, in such a manner as to transfer all tension into the buckle (921). The buckle (921) also has a cylindrical base which will accept the connecting rod and will also bear on the stop (922) when the shelf is in its lowest position (FIGS. 4 and 8).

The stop (922) has two functions: the first is to provide for load transfer as discussed above, and the second is to stop the connecting rod from rotating as the bottom connector is turned. To allow for small variation in the elevation of the buckle during installation, the stop (922) can be installed over the connection rod and inserted inside the vertical guide tube (530) until it comes in contact with the bottom of the buckle (921). Then the set screws (923) in the vertical guide tube (530) can be tightened and thus fix the stop to the vertical guide tube (530).

The connecting rod (910) is a square metal rod and is threaded at the upper end for connection to the buckle (921) and with a long thread at the low end for connection to the bottom connector (920). The rod is sized such that it fits inside a square longitudinal hole in the stop (922), which is in turn a round rod which fits within the vertical guide tube (530). Thus when the stop (922) is fixed to the vertical guide tube (530) as noted above, it will also effectively prevent the connecting rod (910) from twisting, and thus keep the lifting strap (460) from twisting as the bottom connector (920) is turned.

Figure 20:
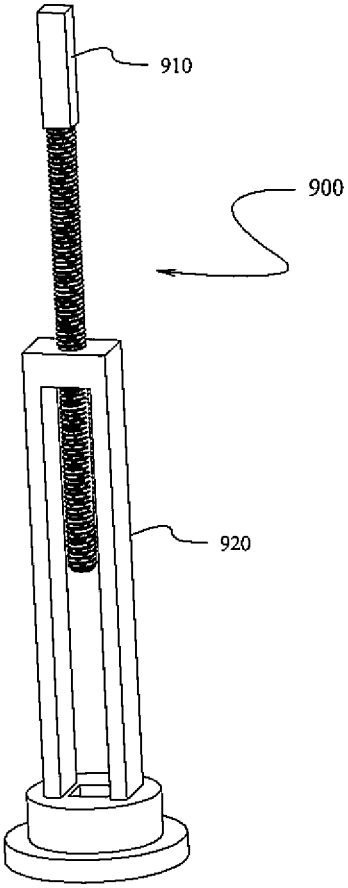
FIG. 20 shows a perspective of the lower shelf connector.

An exploded view of bottom connector (920) is shown in FIG. 20 along with the lower portion of the connecting rod (910). The lower section of the bottom connector (920) includes a cylinder at the base in which the outside diameter and the lip closely match the wall of the lower shelf support tube (810) allowing for weight transfer of the lower shelf to the bottom connector (920) by direct bearing. Just above the base the cylinder is reduced in diameter to match the inside diameter of the lower shelf support tube (810) so as to laterally constrain the two elements. Next a vertical inverted U shape is fixedly attached to the lower section. The inverted U is threaded at the top to accept the threaded portion of the connecting rod (910) so as to allow for vertical adjustment and leveling of the lower shelf (800) by turning the bottom connector (920). The bottom connector (920) is metal, but may be made of other suitable materials, depending on the use and intended lifting weight.

Figure 21:
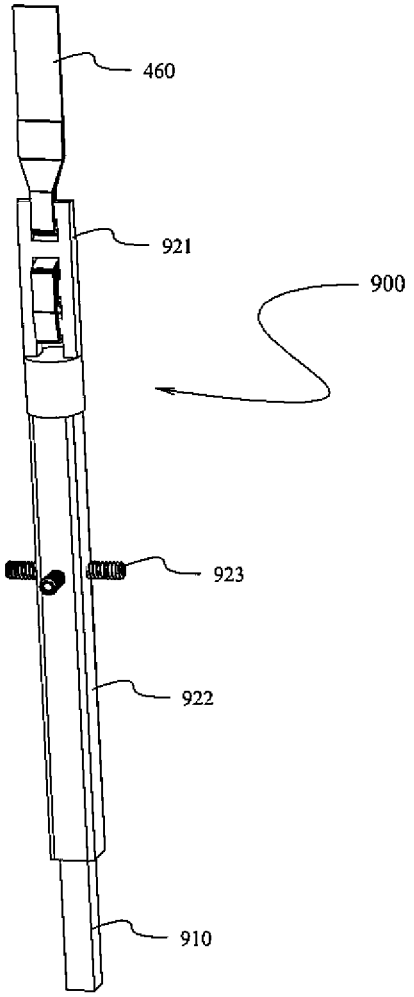
FIG. 21 shows the lifting strap buckle and the tube stop.

An exploded view of the buckle (921) is shown in FIG. 21 along with the stop (922), the set screws (923), the upper portion of the connecting rod (910) and the lifting strap (460). As shown in this figure, the stop (922) may also be a square tube meeting the same size requirements as stated for a rod. The buckle (921) is metal and of one piece, either machined, cast, or molded. The buckle (921) may be made of other suitable materials, depending on the use and intended lifting weight.

Figure 22:
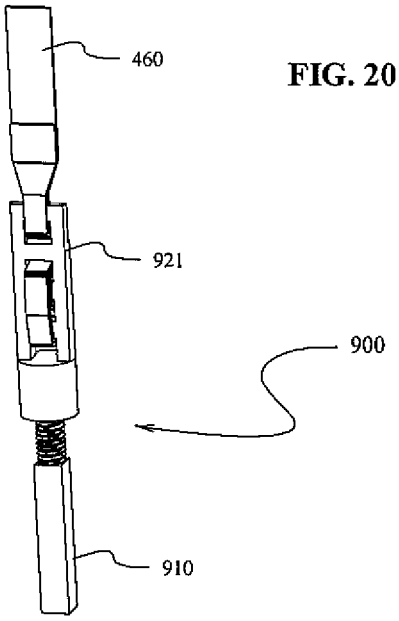
FIG. 22 shows the lifting strap buckle.
Figure 23:
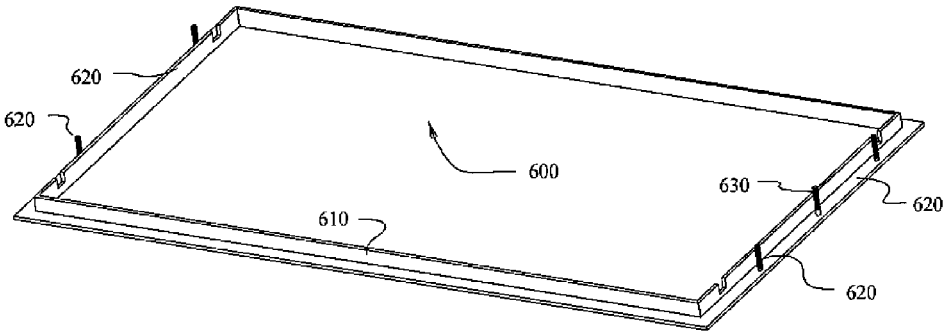
FIG. 23 shows a perspective of the sensor frame.

An exploded view of the buckle (921) is shown in FIG. 22 along with the upper portion of the connecting rod (910) and the lifting strap (460). When the lower shelf (800) is raised above its lowest position, the connecting rod (910) and buckle (921) will be raised above the stop (922) and up into the vertical guide tube (530) as shown in as shown in FIGS. 5, 6, 7 and 9, 10, 11.

Figure 24B:
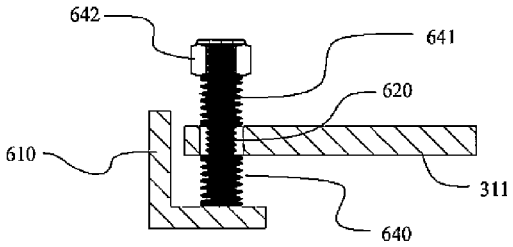
FIG. 24B shows the connection of the sensor frame.
Figure 24:
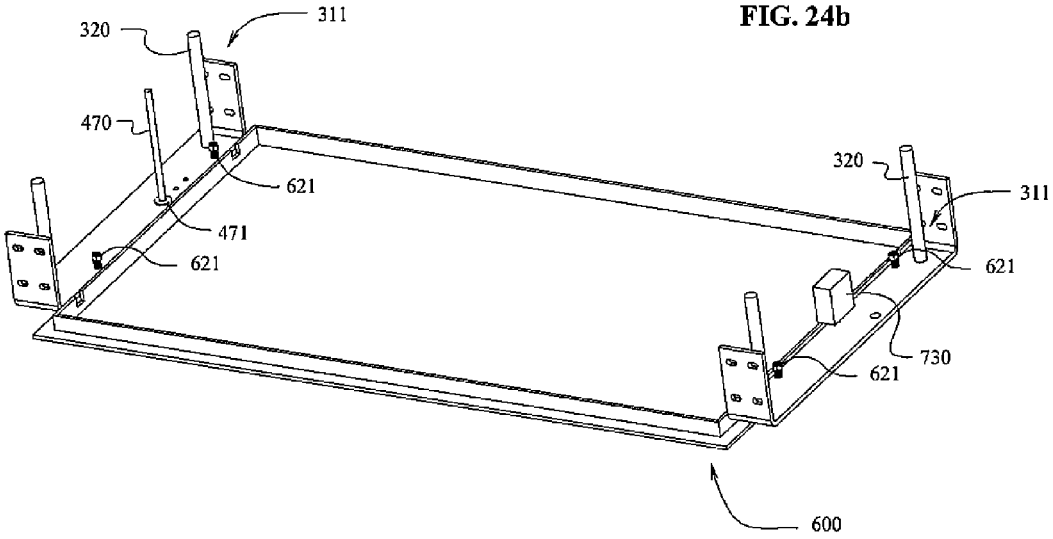
FIG. 24 shows a perspective of the installed sensor frame.

The sensor frame assembly (600) is shown in FIG. 24 and includes the sensor frame (610), threaded studs (620) and the threaded stud for sensor (630). The sensor frame (610) should be of a relatively rigid material such as a metal angle and is made to frame around the opening through which the lower shelf (800) must pass. The threaded studs (620) are fixedly attached to the frame and are of sufficient length to allow for the connection as shown in FIG. 24*b*. The threaded stud for sensor shall be long enough to fasten the acceleration sensor (730) which is located above the bottom vertical guide bracket (311).

The sensor frame (610) is a rigid frame that surrounds the perimeter of the finished opening through which the lower shelf (800) is retracted. The frame's function is to detect when an item on the shelf projects outside the shelf or when the shelf has been knocked or otherwise made to sway such that lifting must be stopped to prevent damage. This is accomplished by fastening the sensor frame (610) to the bottom guide brackets (311) as shown in FIG. 25*b* wherein the threaded studs (620) are passed thorough oversized holes in the bottom guide bracket. Further, a spring (640) is placed between the sensor frame and the bottom guide bracket, and another spring (641) is placed between the bottom guide bracket and the restraining nut (642). The purpose is to allow the sensor frame to move when impacted, but still allow for adjustment as may be required to match finish material around the shelf. It is further noted that the spring stiffness for the upper spring may be greater than the lower spring to facilitate adjustment.

Electrical and electronics (700) are not generally shown but are known in the art. Electronic control of the shelf includes the following: operated by a wall switch, keyed wall switch, remote control, smart phone, a computer, a computer via the internet, incorporated into a smart home system, or any combination of the aforementioned. Specifically shown is a 3D acceleration sensor (730) located on the sensor frame (600), see FIGS. 1 and 24. The sensor will shut off the motor if the sensor frame is accelerated in any direction. Also shown are acceleration or vibration or pressure sensors or some combination thereof (740) located on the underside of the lowest shelf. The purpose is to sense when objects are inadvertently located below the shelf when the shelf is lowered. This is particularly important for operation from a remote location. These and other sensors can be added to sense other phenomena, such as a gyroscope on the shelf to sense when it is tilted beyond some limit, sensors to sense when a load limit is exceeded, etc. Sensors on the underside of the lower shelf (800) may be battery powered and send information to the microcontroller (700) using Wi-Fi. The sensors and Wi-Fi may be put into sleep mode when not in use. A piezo vibration sensor on the lower shelf can be used to wake up the sensors and Wi-Fi upon operation of the shelf.

Referring to FIG. 1 and FIGS. 4, 5, 6, and 7, an example operation of the shelving system is described below. Starting with the shelf on the lowest position as shown in FIG. 1 and FIG. 4, the shelf may be loaded (or unloaded) or otherwise used as a shelf. In this position, the lateral stability of the shelf is provided by the telescoping of the lower shelf support tube (810) over the vertical guide tubes (530), which are part of the floating frame (500). The stability of the floating frame (500) is as discussed above. Additionally, lateral stability in this position is achieved by the transfer of vertical load from the lifting straps (460) to the floating frame (500) and then to the vertical guide frame (300) by direct bearing from the floating frame bracket assemblies (340). In this sense, stability is not unlike a shelf which receives stability from the base; however, unlike a base supported shelf, the lower shelf cannot topple.

As the shelf is raised, the lifting straps raise the lower shelf (800) up until the top reaches the bottom of the ceiling where the lower shelf vertical tubes impact the shock absorbers (551) (see FIG. 19). While lifted up to this point, the lateral stability is provided by the telescoping discussed above. It is noted that at this point, the lower shelf (800) is positively directing into the cabinet above. It is also noted that the stability is increased by the fact that the telescoping height is reduced to zero.

As the lower shelf (800) continues to be raised (see FIG. 6) both the floating frame (500) and the ceiling panel (550) are raised by virtue of the bearing of the floating frame in the lower shelf vertical tubes. As the shelf is lifted into the cabinet, any items that overhang the shelf will impact the sensor frame assembly (600) which will in turn stop the motor. As seen if FIG. 7, the when the shelf is in its raised position, the contents are entirely within an enclosed insulated and sealed space (unless otherwise desired). The underside of the bottom shelf (820) may be decorative to match the adjacent finish of the ceiling as desired. Additionally, a ceiling panel may be applied to the underside of the bottom shelf (820) to house the aforementioned electronics and to provide for an aesthetic ceiling finish when in the raised position.

Although not described in detail above, shelving system may be implemented in other example embodiments. In one example embodiment, a third, intermediate tube that fits inside the shelf vertical tubes and over the vertical guide tubes (530) may be used to provide additional telescoping in the lowered position. This will allow the shelf to be lowered to the floor.

In one example embodiment, the upper cabinet can be built off an upper floor level and allow for open sides or doors. The cabinet may be at some height above the floor as well, by extending the length of the vertical guide rods (320). In one example embodiment, the lower shelf (800) may be replaced with a table, making a table and shelf (if desired) combination. The table, if not retracted into the cabinet, may have a shape that exceeds the ceiling hole. Further, in one example embodiment, larger shelves could be accommodated by using alternate arrangements of vertical shelf tubes, including increasing in number, or even a smaller shelf with a single vertical shelf tube.

In another example embodiment, the two vertical guide rods (320) shown in FIG. 12 may be replaced with a single vertical guide rod located at the middle of the top and bottom vertical guide brackets (310 and 311). The floating frame bracket assembly (340) could then be made more substantial.

In another example embodiment, the motor assembly (440) may be mounted under the top frame (400). This will allow more room for the bracket assembly (340) and winding spools (450) without increasing the overall height of the cabinet (200).

The supporting structure could be any variation that provides the intended support provided by the vertical studs (210) which includes, but is not limited to: isolated cabinets on a floor above, constructed on the side of a tall wall, thus not entering the attic space, an isolated drop ceiling over a (for example) kitchen island. These embodiments demonstrate that there are many applications that follow from that shown by the first embodiment.

It is to be understood that the terms "top", "bottom", "left", "right", "side", "front", "rear", "upper", "lower", "vertical", "horizontal", "height", "width", "length", "end" and the like are used herein merely to describe points of reference and do not limit the present invention to any specific orientation or configuration. The claimed apparatus and components may be of any size, shape or configuration suitable for operation of the apparatus and may be constructed of any suitable materials. In addition, as used in this specification and the appended claims, the singular forms "a", "an", and "the" do not denote a limitation of quantity, but rather denote the presence of at least one of the referenced items unless clearly indicated otherwise. Still further, any and all dimensions shown in attached Figures are example dimensions; dimensions (length, width, height) can vary from those shown.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention.

What is claimed is:

1. A retractable shelving system comprising:

a pair of lifting straps;

a shelf assembly, wherein the shelf assembly includes:

at least two shelf support tubes operably coupled to the lifting straps such that the lifting straps may cause the shelf assembly to move in a vertical direction;

one or more shelves coupled to the at least two shelf support tubes; and a floating frame, wherein the floating frame includes:

a pair of guide tubes, wherein the guide tubes are telescopically disposed within the at least two shelf support tubes, wherein the telescoping vertical guide tubes from above are inside the lower shelf support tubes, and wherein the shelf support tubes engaging the guide tubes by vertical movement causes the floating frame to move in the vertical direction.

2. The retractable shelving system of claim 1, wherein the retractable shelving system further includes a motor assembly operably coupled to the pair of lifting straps.

3. The retractable shelving system of claim 2, wherein the motor assembly is electronically coupled to one or more of: a wall switch, keyed wall switch, remote control, smart phone, and a computer through or one or more of a wired, wireless, or Internet connection.

4. The retractable shelving system of claim 2, wherein the motor assembly is operably coupled to a top frame which is fixed to a framing structure.

5. The retractable shelving system of claim 4, wherein the top frame includes a plurality of guide rods, and wherein plurality of guide rods define the vertical linear motion of the floating frame.

6. The retractable shelving system of claim 1, wherein the floating frame further includes a closure panel.

7. The retractable shelving system of claim 1, wherein the shelf assembly further includes a sensor frame assembly.

8. The retractable shelving system of claim 7, wherein the sensor frame assembly includes a proximity sensor.

9. The retractable shelving system of claim 7, wherein the sensor frame assembly includes an acceleration sensor.

10. The retractable shelving system of claim 1, wherein the retractable shelving system further includes a cabinet.

11. The retractable shelving system of claim 1, wherein the shelf assembly includes a bottom shelf configured to decoratively match the adjacent finish of a ceiling as desired.

12. The retractable shelving system of claim 11, wherein the bottom shelf includes a closure panel operably coupled thereto.

13. The retractable shelving system of claim 12, wherein a sensor configured to detect pressure or relative displacement is located between the bottom shelf and the closure panel.

14. The retractable shelving system of claim 11, wherein the shelf assembly includes a sensor configured to detect pressure or a relative displacement.

* * * * *